US010135158B2

(12) United States Patent
Peltier et al.

(10) Patent No.: US 10,135,158 B2
(45) Date of Patent: Nov. 20, 2018

(54) SPLIT CONNECTOR WITH CIRCULAR DOVE TAIL

(71) Applicants: Tyco Electronics Simel SAS, Gevrey-Chambertin (FR); Tyco Electronics UK Ltd, Wiltshire (GB)

(72) Inventors: Bruno Peltier, St. Apollinaire (FR); Gary Barnett, Ashby de la Zouch/Leics (GB)

(73) Assignees: Tyco Electronics Simel SAS, Gevrey-Chambertin (FR); Tyco Electronics UK Ltd, Wiltshire (GB)

( * ) Notice: Subject to any disclaimer, the term of this patent is extended or adjusted under 35 U.S.C. 154(b) by 0 days.

(21) Appl. No.: 15/331,122

(22) Filed: Oct. 21, 2016

(65) Prior Publication Data

US 2017/0117644 A1 Apr. 27, 2017

(30) Foreign Application Priority Data

Oct. 21, 2015 (EP) ..... 15306691

(51) Int. Cl.

| | |
|---|---|
| ***H01R 11/09*** | (2006.01) |
| ***H01R 11/26*** | (2006.01) |
| ***H01R 4/36*** | (2006.01) |
| ***H01R 13/631*** | (2006.01) |
| *H01R 4/00* | (2006.01) |
| *H01R 13/213* | (2006.01) |
| *H01R 13/621* | (2006.01) |

(52) U.S. Cl.

CPC ..... *H01R 11/26* (2013.01); *H01R 4/36* (2013.01); *H01R 13/631* (2013.01); *H01R 4/54* (2013.01); *H01R 13/213* (2013.01); *H01R 13/621* (2013.01)

(58) Field of Classification Search

CPC . H01R 4/36; H01R 4/363; H01R 4/32; H01R 4/307; H01R 11/09

USPC ..... 439/797

See application file for complete search history.

(56) References Cited

U.S. PATENT DOCUMENTS

| | | | | |
|---|---|---|---|---|
| 2,713,154 A * | 7/1955 | Bilsborough | H01R 13/115 | 439/287 |
| 3,727,171 A * | 4/1973 | Coles | H01R 4/34 | 439/110 |
| 4,053,202 A * | 10/1977 | Norden | H01R 4/36 | 439/814 |
| 4,458,976 A * | 7/1984 | Hudson | H01R 4/46 | 439/785 |
| 4,568,138 A * | 2/1986 | McKenzie | H01R 4/48 | 439/592 |

(Continued)

FOREIGN PATENT DOCUMENTS

| | | |
|---|---|---|
| EP | 1280239 A2 | 1/2003 |
| EP | 1914837 A2 | 4/2008 |

(Continued)

OTHER PUBLICATIONS

European Search Report, dated Apr. 11, 2016, 10 pages.
Abstract of WO2014079558, dated May 30, 2014, 1 page.

*Primary Examiner* — Abdullah Riyami
*Assistant Examiner* — Vladimir Imas
(74) *Attorney, Agent, or Firm* — Barley Snyder

(57) ABSTRACT

An electrical connector is disclosed. The electrical connector has a first body and a second body. The second body is mechanically coupled to the first body in a coupling state and enters the coupling state through a lateral side of the first body.

17 Claims, 5 Drawing Sheets

(56) References Cited

U.S. PATENT DOCUMENTS 5,000,705 A * 3/1991 Kinka ..... H01R 4/5091 439/791
5,199,905 A * 4/1993 Fillinger ..... H01R 4/34 439/723
5,727,314 A * 3/1998 Ashcraft ..... H01R 4/36 29/884
5,876,224 A * 3/1999 Chadbourne ..... H01R 4/34 439/110
6,284,976 B1 * 9/2001 Pulido ..... H02G 15/013 174/74 R
6,338,658 B1 * 1/2002 Sweeney ..... H01R 4/36 439/709
6,872,096 B2 * 3/2005 Baker ..... H01R 11/09 439/654
6,909,049 B2 * 6/2005 DiTroia ..... H01R 11/09 174/84 C
7,044,776 B2 * 5/2006 King, Jr. ..... H01R 4/36 439/521
7,056,163 B2 * 6/2006 Hay ..... H01R 4/36 439/810
7,320,626 B2 * 1/2008 Drane ..... H01R 4/307 439/798
7,537,467 B1 * 5/2009 Gretz ..... H01R 4/36 439/108
7,585,193 B2 * 9/2009 Hagmann ..... H01R 4/307 439/811
7,717,658 B2 * 5/2010 Peltier ..... F16B 31/021 411/383
7,896,714 B2 * 3/2011 Moist ..... H01R 4/36 439/271
7,931,508 B1 * 4/2011 Carr ..... H01R 4/36 439/798
8,267,730 B2 * 9/2012 Stauch ..... H01R 4/307 411/383
8,277,263 B1 * 10/2012 Smith ..... H01R 4/32 439/779
8,425,264 B2 * 4/2013 Michell ..... H01R 4/42 439/789
8,480,442 B2 * 7/2013 Pini ..... H01R 4/36 439/814
9,472,865 B2 * 10/2016 Frank ..... H01R 4/307
9,502,789 B2 * 11/2016 Umlauf ..... H01R 4/36
2005/0130489 A1 * 6/2005 Barnett ..... F16B 31/021 439/475
2013/0295790 A1 * 11/2013 Cornelius ..... H01R 4/36 439/359

FOREIGN PATENT DOCUMENTS

GB 2319402 A 5/1998
WO 2014079558 A1 5/2014

* cited by examiner

SPLIT CONNECTOR WITH CIRCULAR DOVE TAIL

CROSS-REFERENCE TO RELATED APPLICATION

This application claims the benefit of the filing date under 35 U.S.C. § 119(a)-(d) of European Patent Application No. 15306691.5, filed on Oct. 21, 2015.

FIELD OF THE INVENTION

The present invention relates to a connector, and more particularly, to a bolted connector for connecting electrical cables.

BACKGROUND

In known bolted connectors used for connecting electrical cables, ends of the cables are inserted into connector bodies and fixed in place by a series of fastening bolts. The bolts are tightened through threaded holes provided in the body of the connector for clamping the cable ends. Bolted connectors present several advantages over other types of connectors, such as crimped connectors, because they are easier to install and require no specialized tools.

Bolted connectors, however, generally require that the electrical cable ends are inserted into bores provided in the connector body. Consequently, the use of conventional bolted connectors may be difficult in applications where one or more of the electrical cables to be joined are already fixed to an installation and/or are not easy to bend due to the cable thickness. For instance, some power cables are designed with three phases plus a neutral one or with four phases in the same outer sheath. Moreover, the cores of these power cables are often sectorial shapes. When it is necessary to join two of these cables with a bolted connector, two situations may arise. First, once the cables for the first phase are connected, the two cables are linked together and it is no longer possible to move them away for gaining additional space for connecting the other phases. Thus, when trying to connect the cables of the second phase, it is almost impossible to introduce the two cores in each side of the connector body. Secondly, it may happen that the two sector shapes are not in line, i.e. not in the same orientation. In such cases, the diameter of the connector bore should be bigger than the largest dimension of the sector in order to permit the sector to be introduced into the connector in any direction. As a consequence, it is difficult to provide a connector with a compact design that also allows connecting sector shapes with different orientations.

International patent application WO 2014/079558 A1, for instance, describes a bolted connector for the electrical attachment or connection of at least one conductor of an energy supply cable that allows bringing two connector bodies into an alignment coupling by inserting one of the connector bodies at a certain angle with respect to the alignment direction. The device comprises two cables with different orientations. A first connector body of the device is connectable to both the conductor and a second connector body by a clamping element. The central longitudinal axes of the two connector bodies align in the connected state.

Moreover, in known bolted connectors, in order to ensure that the threads of the holes that receive the bolts are not destroyed when the bolts are tightened the connector body is often made from a hard conducting material such as aluminum alloy from the 2000 or 6000 series. Such bolted connectors have the shortcoming that they are not as conductive as the electrical cables to be joined by the connector and are less conductive than crimped connectors. For this reason, known bolted connectors generally require a larger size and the use of conductive fastening bolts to help to offset the impact of using a lower conducting material for the connector body.

SUMMARY

An object of the invention, among others, is to provide a connector of a compact size that is easy to install, even in situations where the electrical cables to be connected are difficult to bend or to be displaced, while providing good mechanical and electrical coupling properties. The disclosed electrical connector has a first body and a second body. The second body is mechanically coupled to the first body in a coupling state and enters the coupling state through a lateral side of the first body.

BRIEF DESCRIPTION OF THE DRAWINGS

The invention will now be described by way of example with reference to the accompanying figures, of which.

DETAILED DESCRIPTION OF THE EMBODIMENT(S)

The invention is explained in greater detail below with reference to embodiments of a connector. This invention may, however, be embodied in many different forms and should not be construed as limited to the embodiments set forth herein; rather, these embodiments are provided so that this disclosure will be thorough and complete and still fully convey the scope of the invention to those skilled in the art.

Figure 1:
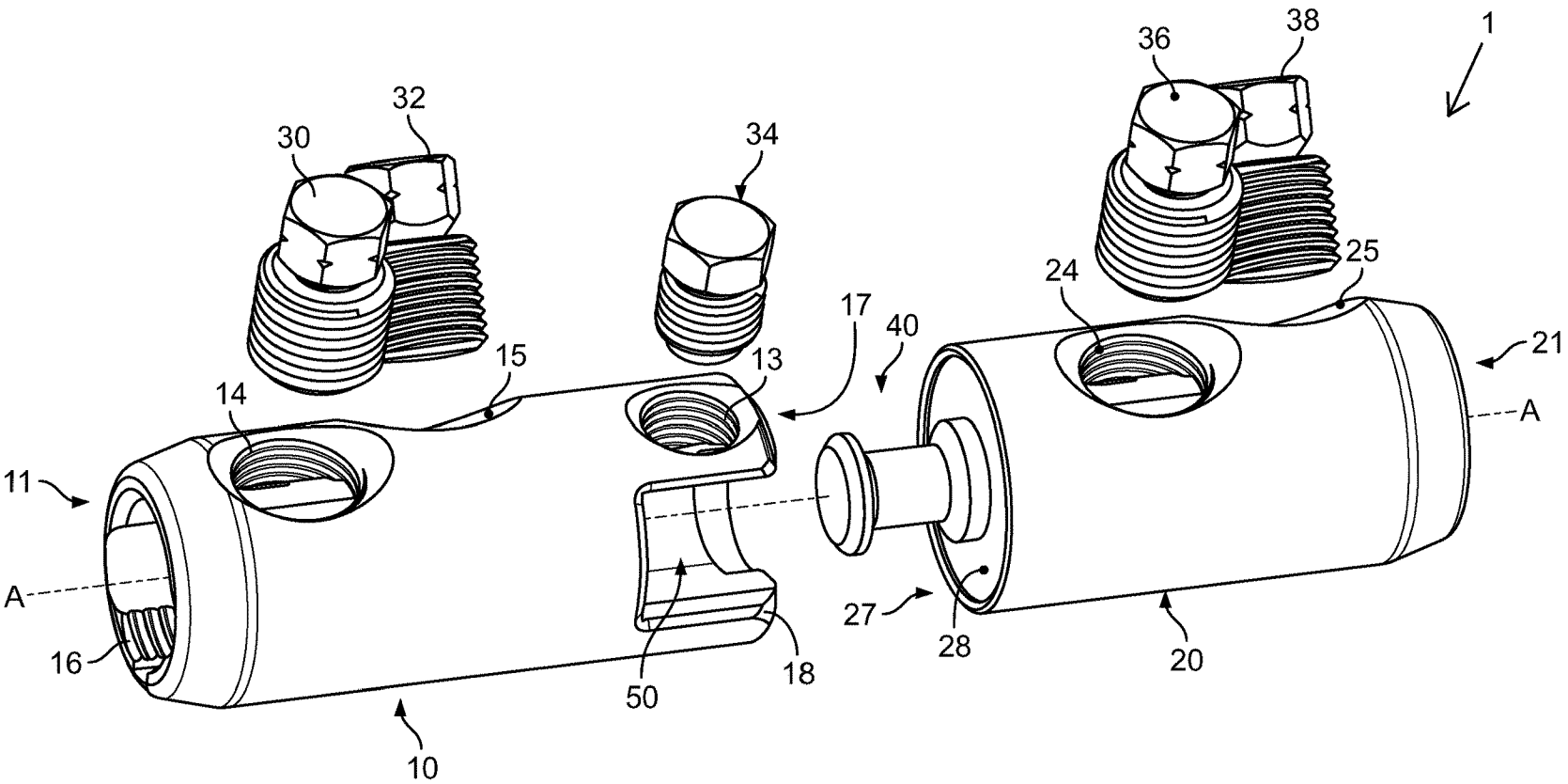
FIG. 1 is a perspective view of a connector according to the invention.

A connector 1 according to the invention is shown generally in FIG. 1. The connector 1 has a first body 10, a second body 20, a plurality of clamping bolts 30, 32, 36, 38, a coupling bolt 34, a coupler 40, and a cavity 50. The major components of the invention will now be described in greater detail.

Figure 2:
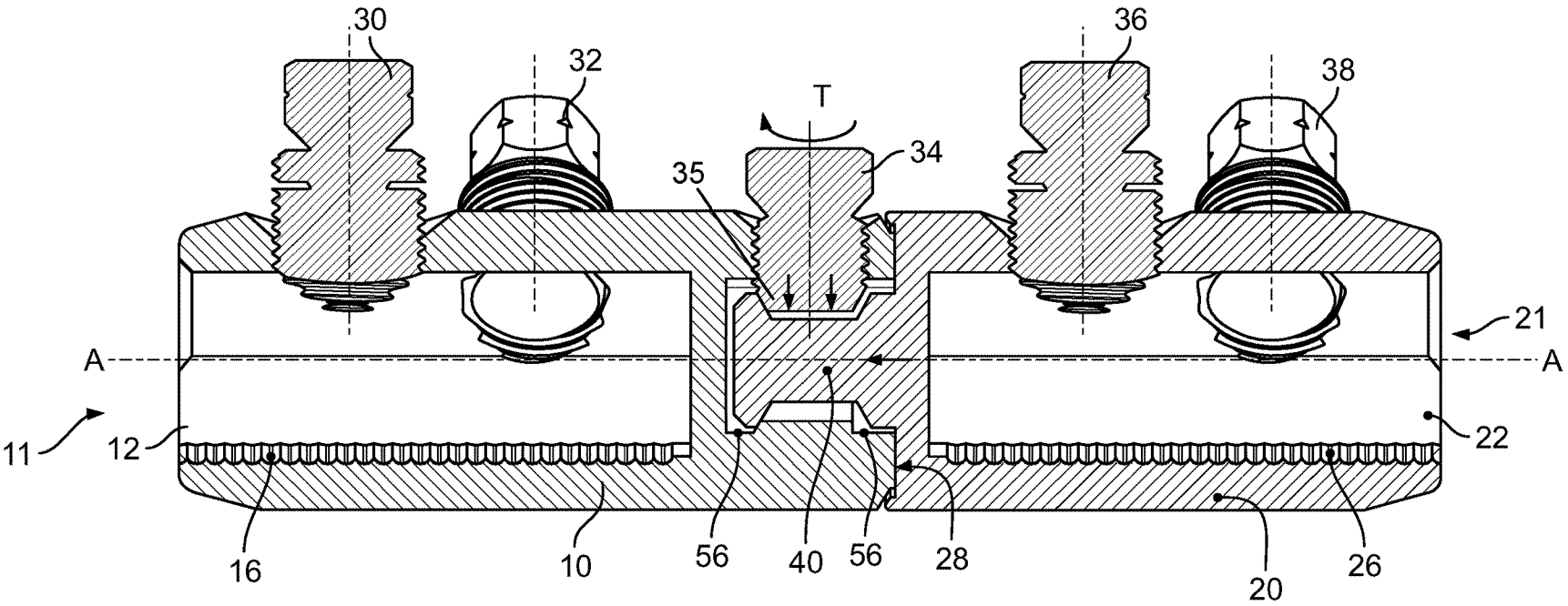
FIG. 2 is a sectional view of the connector of FIG. 1.

The first and second bodies 10, 20, as shown in FIGS. 1, 2, 4, and 7, have an outer shape that is approximately cylindrical with respective central axes CC'. As shown in FIG. 2, the respective central axes CC' become aligned when the first and second bodies 10, 20 are joined together in a coupling state, resulting in a connector 1 with an approximate cylindrical shape along the longitudinal axis AA'.

The first body 10 is shown in FIGS. 1, 2, and 6-9. As shown in FIG. 2, a rear end 11 of the first body 10 has a first passageway 12. An end of a first electrical cable is fixed in the first passageway 12 by means of one or more first clamping bolts 30, 32 that are tightened in a plurality of first clamping threaded passageways 14, 15 provided on an upper side of the first body 10. The first clamping bolts 30, 32 clamp the first electrical cable to the first body 10 by pressing the cable against an inner side of the first passageway 12. In order to improve the fixation of the electrical cable to the first body 10, the inner side of first passageway 12 may be provided with a first structured surface 16 against which the electrical cable is pressed when the first clamping bolts 30, 32 are tightened. As shown in FIG. 2, the first structured surface 16 extends along the length of the first passageway 12, on a side opposite the first clamping threaded passageways 14, 15. The first structured surface 16 increases the friction between the electrical cable and the inner side of the first passageway 12, so that the electrical cable can be efficiently secured by applying less tightening torque to the first clamping bolts 30, 32, reducing or avoiding damage to the threads of the first clamping threaded passageways 14, 15.

The second body 20 is shown in FIGS. 1-5 and 9. As shown in FIG. 2, a rear end 21 of the second body 20 has a second passageway 22. An end of a second electrical cable is fixed in the second passageway 22 by means of one or more second clamping bolts 36, 38 that are tightened in a plurality of second clamping threaded passageways 24, 25 provided on an upper side of the second body 20. The second clamping bolts 36, 38 clamp the second electrical cable to the second body 20 by pressing the cable against an inner side of the second passageway 22. In order to improve the fixation of the electrical cable to the second body 20, the inner side of second passageway 22 may be provided with a second structured surface 26 against which the electrical cable is pressed when the second clamping bolts 36, 38 are tightened. As shown in FIG. 2, the second structured surface 26 extends along the length of the second passageway 22 on a side opposite the second clamping threaded passageways 24, 25. The second structured surface 26 increases the friction between the electrical cable and the inner side of the second passageway 22, so that the electrical cable can be efficiently secured by applying less tightening torque to the second clamping bolts 36, 38, reducing or avoiding damage to the threads of the second clamping threaded passageways 24, 25.

In other embodiments, the first structured surface 16 and the second structured surface 26 may extend over different areas or over the whole surface of the inner side of, respectively, the first passageway 21 and the second passageway 22 depending on the application. The first and second structured surfaces 16, 26 may also be divided into more than one structured area.

Figure 3:
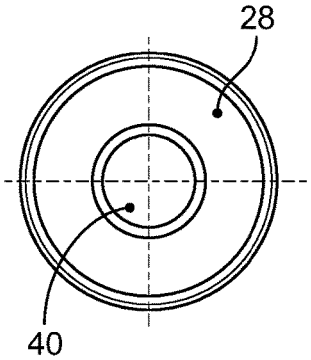
FIG. 3 is a front view of a second body of the connector of FIG. 1.
Figure 4:
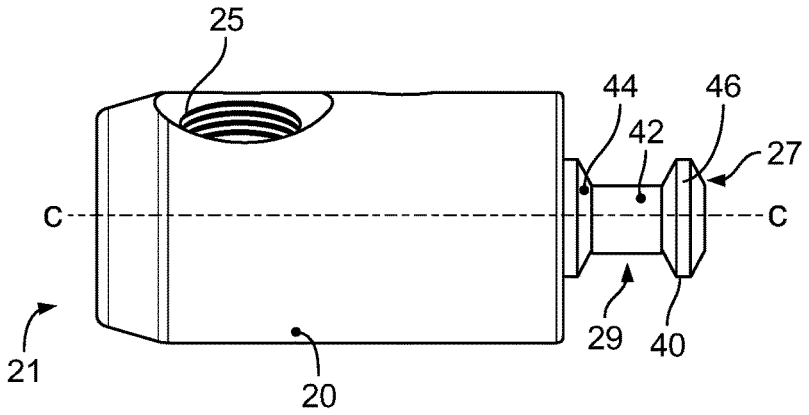
FIG. 4 is a side view of the second body of FIG. 3.
Figure 5:
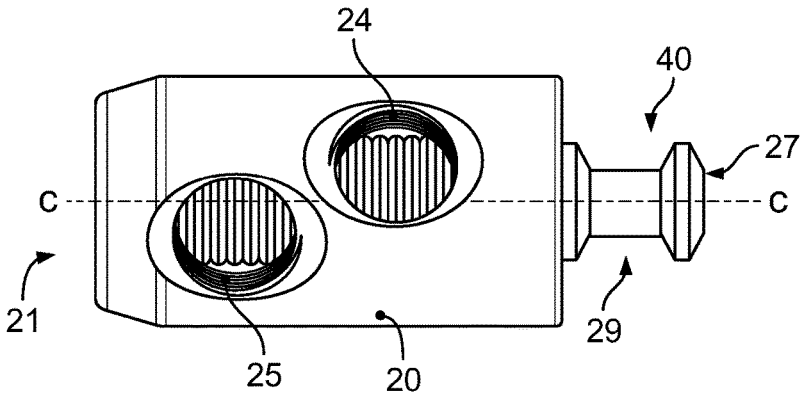
FIG. 5 is a top view of the second body of FIG. 3.

The coupler 40, as shown in FIGS. 1, 3, and 4, is disposed at a front end 27 of the second body 20 opposite the rear end 21 of the second body 20. The coupler 40 is a protrusion extending from a center of the front end 27 of the second body 20 along the central axis CC'. The coupler 40 may have a circular profile and a shape with cylindrical symmetry about the central axis CC'. As shown in FIGS. 4 and 5, the coupler 40 may have a circular, dovetail profile having an inner region 42 of a cylindrical shape with two conical shapes 44, 46 at opposed sides of the inner region 42. The circular, dovetail profile of the coupler 40 results in an annular groove 29 of inclined edges that extends around the perimeter of the coupler 40. In the shown embodiment, the angle of the inclined surface of the conical shapes 44, 46 with respect to the horizontal direction CC' is 30°. In other embodiments, a range from 20° to 85° may be used.

Figure 7:
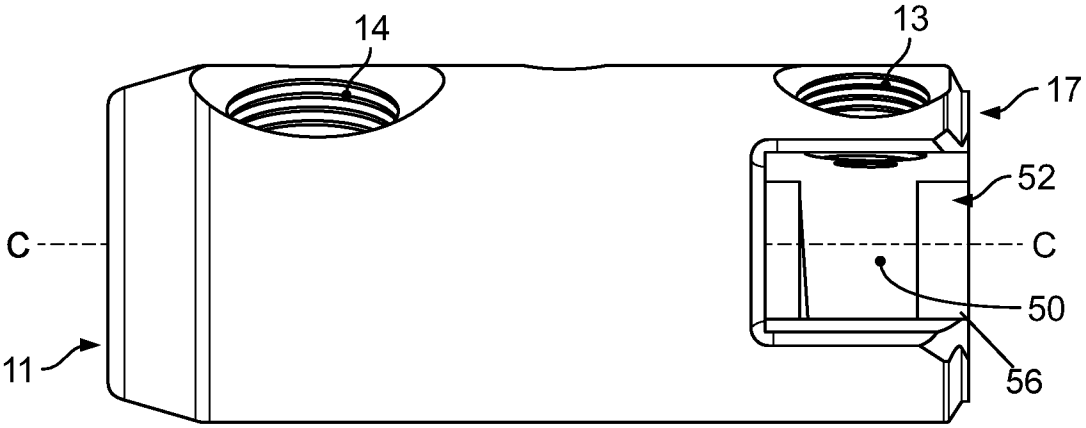
FIG. 7 is a side view of the first body of FIG. 6.
Figure 8:
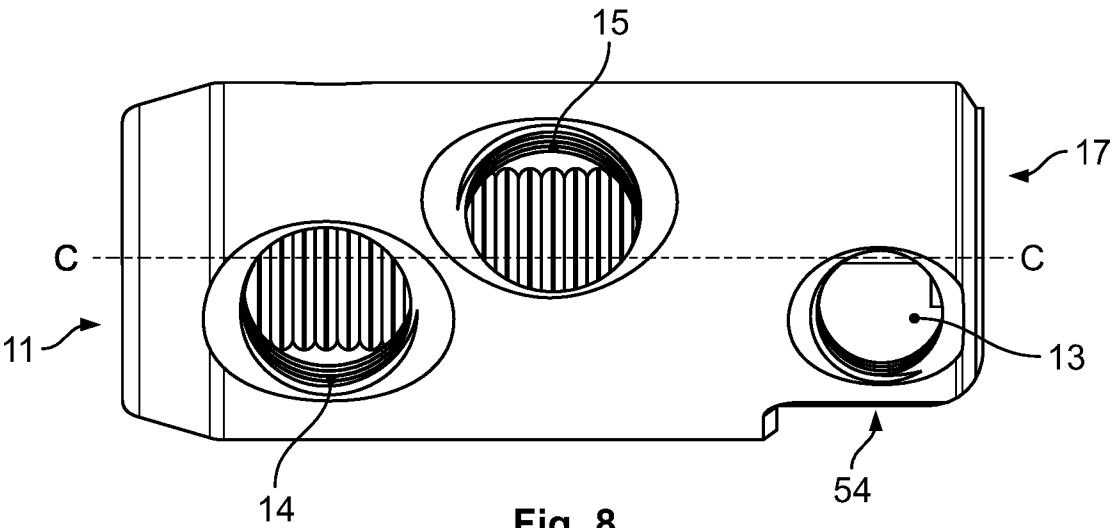
FIG. 8 is a top view of the first body of FIG. 6.
Figure 6:
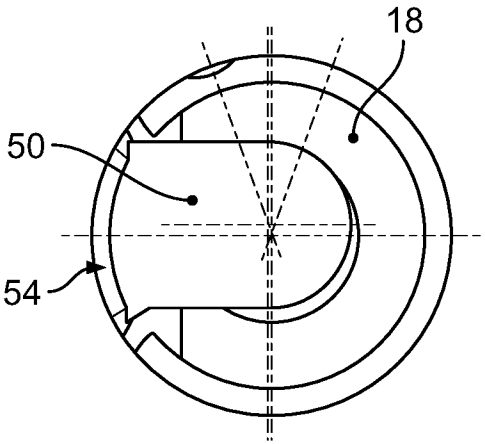
FIG. 6 is front view of a first body of the connector of FIG. 1.

The cavity 50, as shown in FIGS. 6-8, is disposed at a front end 17 of the first body 10 opposite the rear end 11 of the first body 10. The cavity 50 has a frontal opening 52 on the front end 17 of the first body 10. In an embodiment of the invention, the cavity 50 also has a lateral opening 54 disposed on a lateral side of the first body 10 extending from the frontal opening 52 to an end of the cavity 50. The cavity 50, as shown in FIG. 2, further has one or more recesses 56 that are disposed on a portion of the inner profile of the cavity 50.

The first body 10 and the second body 20 are configured to be mechanically coupled together; the connector 1 is a split connector formed by connecting two halves that correspond to the first and second bodies 10, 20. However, the principles of the present invention may also be applied to other types of mechanical connectors formed by more than two connecting parts.

The connector 1 is shown in a decoupled state in FIG. 1. In order to mechanically connect the first and second bodies 10, 20 to the coupled state shown in FIG. 2, the coupler 40 is inserted in the cavity 50. The frontal opening 52 receives the coupler 40 in a longitudinal direction when the second body 20 abuts with the first body 10 along a front-end to front-end direction, i.e. along the axis direction CC'. For situations where the electrical cables connected to the first and second bodies 10, 20 are fixed and/or cannot be easily bent, the coupler 40 is inserted laterally into the cavity 50 via the lateral opening 54. In the shown embodiment, the cavity 50 has single lateral opening 54, so that the coupler 40 may be inserted from only one lateral side of the first body 10. However, in other embodiments, the cavity 50 has more than one lateral opening 54 permitting lateral insertion of the coupler 40 from several lateral sides of the first body 10. The one or more recesses 56, as shown in FIG. 2, receive the edges of the coupler 40.

The cylindrical symmetry of the coupler 40 permits the coupler 40 to be inserted inside the coupling cavity 50 with any orientation and to be freely rotated by 360° about the longitudinal axis AA'. Moreover, the coupling cavity 50 is also provided with an inner profile that matches at least a part of the shape of the coupler 40 and permits the free rotation of the coupler 40. Thus, since the connection between the two connecting parts 10, 20 has a free rotation of 360°, each of the connecting parts 10, 20 can be oriented in line with a sector shape of the first and second electrical cables.

Figure 9:
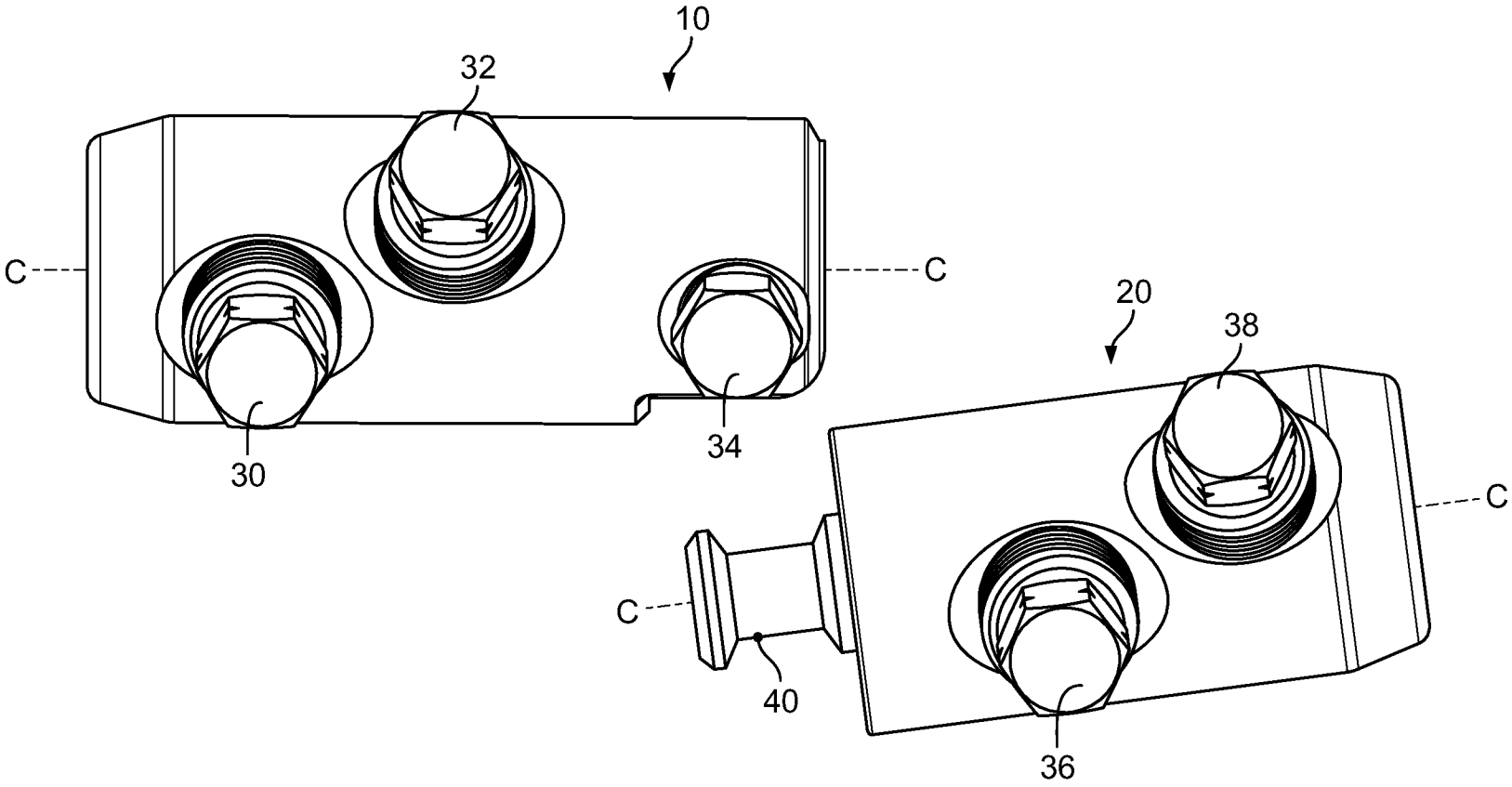
FIG. 9 is a top view of the connector of FIG. 1.

The first and second bodies 10, 20 are fixed together in the coupling state shown in FIG. 2 by the coupling bolt 34 that is tightened through a coupling threaded passageway 13 positioned above the cavity 50. The coupling bolt 34 is tightened by a tightening torque T to clamp the coupler 40 against an opposed side of the cavity 50. As shown in FIG. 8, in order to facilitate the tightening of the coupling bolt 34 after the coupler 40 is inserted in the coupling cavity 50, the coupling threaded passageway 13 is disposed on the upper side of the first body 10 with an angular displacement with respect to the nearest first clamping threaded passageway 15. An angular displacement of 30° can be used. Moreover, the other clamping threaded passageways 14, 24, and 25 provided on the upper side of the first and second bodies 10, 20 may also be provided with a non-zero angular displacement with respect to each other, instead of being aligned in a same direction, so as to facilitate tightening of the respective clamping bolts 30, 32, 36, and 38, as shown in FIG. 9.

The coupling bolt 34 contacts the annular groove 29, and consequently, the coupling bolt 34 can clamp the coupler 40 against a side of the cavity 50 irrespectively of the orientation of the coupler 40 inside the cavity 50. The first and second bodies 10, 20 can be clamped in any rotation position with respect to each other. The coupling bolt 34, as shown in FIG. 2, has a tip 35 having a conical shape with a flat base and inclined edges, matching the angle profile of the annular groove 29. The tip 35 increases the contact surface between the annular groove 27 and the coupling bolt 34 and limits relative longitudinal displacement of the second body 20 once coupled.

In order to establish a good electrical connection between the first and second bodies 10, 20 in the coupled state, an electrical contact element 28, as shown in FIGS. 2 and 3, may be disposed on the front end 27 of the second body 20. The electrical contact element 28 may be provided as a flat surface, such as a disc, located on the front side 27 of the second body 10 so as to touch a border 18 of the front side 17 of the first body 10 when the two bodies 10, 20 are joined together. The electrical contact element 28 may be formed as the contact surface of the front side 27 of the second body 20 or may be provided as an additional material having good electrical properties. The electrical coupling may be further improved by providing a corresponding electrical contact element on the border 18 of the first body 10.

When the coupling bolt 34 is tightened against the coupler 40 located inside the cavity 50, the force applied by the inclined edges of the tip 35 against the inclined edges of the groove 29 forces the coupler 40 to move fully into the cavity 50, thereby bringing the first and second bodies 10, 20 together and efficiently securing the coupler 40 inside the cavity 50. The tightening of the coupling bolt 34 also forces the edges of the coupler 40 to enter into the recesses 56, the recesses 56 engaging the coupler 40 and locking the coupler 40 into the coupling position. At the same time, since the electrical contact element 27 is also pressed against the border 18 at the front edge of the first body 10 when the coupling bolt 34 is tightened, a good and stable electrical coupling between the first and second connecting parts 10, 20 can be ensured.

Although the above embodiments of the connector 1 were described in view of the application of the connector 1 to connect electrical power supply cables, the principles of the present invention can also be advantageously applied to any mechanical connector and/or for other applications.

Advantageously, in the connector 1 according to the invention, the connector 1 is a split connector formed by connecting two halves that correspond to the first and second bodies 10, 20; this has the advantage that the connector 1 has a compact design and is easy to install. Furthermore, due to the relative angular displacement among the threaded passageways 13, 14, 15, 24, and 25, the plurality of clamping bolts 30, 32, 36, and 38 and the coupling bolt 34 can be located closer to each other, further reducing the size of the connector 1. Additionally, by establishing the electrical coupling between the first and second bodies 10, 20 via electrical contact elements as described above, the electrical contact is no longer done by the coupler 40 but by the larger flat surface of the electrical contact element itself, leading to a better electrical connection.

What is claimed is:

1. An electrical connector, comprising:

a first body having a cavity with a lateral opening and a threaded passageway;

a second body mechanically coupled to the first body in a coupling state, the second body having a coupler entering the cavity in a lateral direction orthogonal to a longitudinal direction of the first body through the lateral opening of the first body;

a clamping bolt received in the threaded passageway of the first body; and a coupling bolt smaller in diameter and different in shape than the clamping bolt extending through a coupling threaded passageway positioned above the cavity, abutting the coupler inside the cavity, and fixing the first body to the second body in the coupling state, the coupling bolt having a tip with a flat base and a pair of inclined edges, the flat base engaging an inner region of the coupler and the pair of inclined edges engaging a pair of conical shapes of the coupler disposed on opposite sides of the inner region.

2. The electrical connector of claim 1, wherein a front end of the first body is mechanically coupled to a front end of the second body in the coupling state.

3. The electrical connector of claim 1, wherein the coupler abuts the cavity in the coupling state.

4. The electrical connector of claim 1, wherein the cavity has a frontal opening receiving the coupler in the longitudinal direction.

5. The electrical connector of claim 1, wherein the coupler is a protrusion extending from a front end of the second body along a central axis of the second body, the coupler having a shape with cylindrical symmetry about the central axis.

6. The electrical connector of claim 5, wherein the coupler has a circular, dovetail profile.

7. The electrical connector of claim 6, wherein the cavity has an inner profile matching at least a part of the shape of the coupler.

8. The electrical connector of claim 6, wherein the inner profile of the cavity has one or more recesses engaging the coupler.

9. The electrical connector of claim 6, wherein the tip of the coupling bolt has a shape that matches an outer shape of the coupler.

10. The electrical connector of claim 9, wherein the tip has a conical shape matching the dovetail profile of the coupler.

11. The electrical connector of claim 10, wherein the tip moves the coupler into the cavity when the coupling bolt is tightened against the coupler.

12. The electrical connector of claim 1, further comprising an electrical contact element disposed on a front end of the second body and electrically connected with a border on a front end of the first body.

13. The electrical connector of claim 12, wherein the electrical contact element is a disc of electrically conductive material, the electrical contact element pressed against the border when the first body is coupled to the second body.

14. The electrical connector of claim 1, wherein the first body and the second body have a plurality of clamping threaded passageways receiving a plurality of clamping bolts clamping cables to the first body and the second body.

15. The electrical connector of claim 14, wherein the plurality of clamping threaded passageways are disposed on an upper side of the first body and the second body with a non-zero displacement angle with respect to each other.

16. The electrical connector of claim 1, wherein the connector is a split connector.

17. The electrical connector of claim 1, wherein the coupler has a circular profile and the second body can be coupled to the first body in any rotation position.

* * * * *